US009780444B2

(12) United States Patent
Huang et al.

(10) Patent No.: US 9,780,444 B2
(45) Date of Patent: Oct. 3, 2017

(54) ANTENNA HAVING A CABLE GROUNDING AREA

(71) Applicant: ARCADYAN TECHNOLOGY CORPORATION, Hsinchu (TW)

(72) Inventors: Chih-Yung Huang, Hsinchu (TW); Kuo-Chang Lo, Hsinchu (TW)

(73) Assignee: ARCADYAN TECHNOLOGY CORP., Hsinchu (TW)

( * ) Notice: Subject to any disclaimer, the term of this patent is extended or adjusted under 35 U.S.C. 154(b) by 101 days.

(21) Appl. No.: 14/803,543

(22) Filed: Jul. 20, 2015

(65) Prior Publication Data

US 2016/0190681 A1 Jun. 30, 2016

(30) Foreign Application Priority Data

Dec. 24, 2014 (TW) ..... 103145349 A

(51) Int. Cl.
*H01Q 9/04* (2006.01)
*H01Q 1/48* (2006.01)
(Continued)

(52) U.S. Cl.
CPC ..... *H01Q 1/48* (2013.01); *H01Q 1/50* (2013.01); *H01Q 9/42* (2013.01); *H01Q 13/10* (2013.01);
(Continued)

(58) Field of Classification Search
CPC .. H01Q 1/38; H01Q 1/50; H01Q 1/48; H01Q 1/241; H01Q 1/242; H01Q 1/243; H01Q 9/40; H01Q 9/42; H01Q 9/0421
(Continued)

(56) References Cited

U.S. PATENT DOCUMENTS 6,111,552 A * 8/2000 Gasser ..... H01Q 1/1271 343/700 MS
7,791,545 B2 * 9/2010 Lin ..... H01Q 1/36 343/700 MS
(Continued)

FOREIGN PATENT DOCUMENTS

TW M297052 9/2006
TW M359062 6/2009

OTHER PUBLICATIONS

Office Action/Search Report for Corresponding Application TW 103145349 filed Dec. 24, 2014.

*Primary Examiner* — Jessica Han
*Assistant Examiner* — Awat Salih
(74) *Attorney, Agent, or Firm* — Gottlieb, Rackman & Reisman, P.C.

(57) ABSTRACT

An antenna is provided. The antenna includes a feed-in terminal; a radiating portion extended from the feed-in terminal along a first direction to form a first hook portion; a connecting conductor extended from the feed-in terminal to a ground terminal along a second direction opposite to the first direction; and a ground portion extended from the ground terminal and having a cable grounding area, wherein the ground portion and the connecting conductor form a second hook portion opposite to the first hook portion; the cable grounding area has a longitudinal center line; and the first direction and the longitudinal center line form therebetween a specific angle ranging from 49-59 degrees.

18 Claims, 6 Drawing Sheets

(51) Int. Cl.
*H01Q 9/42* (2006.01)
*H01Q 13/10* (2006.01)
*H01Q 1/50* (2006.01)
*H01Q 1/24* (2006.01)
*H01Q 1/38* (2006.01)

(52) U.S. Cl.
CPC ..... *H01Q 1/241* (2013.01); *H01Q 1/242* (2013.01); *H01Q 1/243* (2013.01); *H01Q 1/38* (2013.01); *H01Q 9/0421* (2013.01)

(58) Field of Classification Search
USPC ..... 343/702, 829, 845–849
See application file for complete search history.

(56) References Cited

U.S. PATENT DOCUMENTS 7,986,281 B2 * 7/2011 Hsiao ..... H01Q 1/38 343/700 MS
8,111,195 B2 * 2/2012 Hung ..... H01Q 9/0407 343/700 MS
9,306,285 B2 * 4/2016 Huang ..... H01Q 1/243
9,401,543 B2 * 7/2016 You ..... H01Q 9/42
2004/0178957 A1 * 9/2004 Chang ..... H01Q 1/22 343/700 MS
2009/0073051 A1 * 3/2009 Liu ..... H01Q 1/38 343/700 MS
2009/0195473 A1 * 8/2009 Ke ..... H01Q 1/2266 343/846
2009/0231230 A1 * 9/2009 Hung ..... H01Q 1/243 343/848
2010/0127941 A1 * 5/2010 Chiang ..... H01Q 1/243 343/700 MS
2011/0025566 A1 * 2/2011 Suh ..... H01Q 1/2266 343/702
2011/0122042 A1 * 5/2011 Huang ..... H01Q 1/243 343/860
2012/0081261 A1 * 4/2012 Huang ..... H01Q 7/00 343/866
2014/0009359 A1 * 1/2014 Huang ..... H01Q 1/38 343/846
2014/0285380 A1 * 9/2014 Du ..... H01Q 1/38 343/700 MS
2014/0320370 A1 * 10/2014 Huang ..... H01Q 9/0421 343/848
2014/0347241 A1 * 11/2014 Kim ..... H01Q 1/243 343/845
2015/0029071 A1 * 1/2015 Hwang ..... H01Q 5/35 343/845
2015/0194729 A1 * 7/2015 Huang ..... H01Q 5/371 343/843
2015/0200448 A1 * 7/2015 Tsai ..... H01Q 1/243 343/702
2016/0049732 A1 * 2/2016 Huang ..... H01Q 9/0407 343/848

* cited by examiner

ANTENNA HAVING A CABLE GROUNDING AREA

CROSS-REFERENCE TO RELATED APPLICATION AND CLAIM OF PRIORITY

The application claims the benefit of the Taiwan Patent Application No. 103145349 filed on Dec. 24, 2014 in the Taiwan Intellectual Property Office, the disclosures of which are incorporated herein in their entirety by reference.

FIELD OF THE INVENTION

The present invention relates to an antenna, and more particularly to an antenna having a cable grounding area.

BACKGROUND OF THE INVENTION

Nowadays, various compact antennas have been developed and applied to various compact hand-held electronic devices (e.g. cellphones or notebook computers) or the wireless transmission device (e.g. the access point (AP)). For example, the planar inverse-F antenna (PIFA) that is compact, has a good transmitting efficiency, and can be easily disposed on the inner wall of the hand-held electronic device already exists, and is widely applied to various hand-held electronic devices, the notebook computer or the wireless communicating device for wireless communication.

The antenna currently used for the hand-held electronic device is usually manufactured on the edge of the system circuit board of the hand-held electronic device. In addition, the ground of the antenna is connected to a ground metal on the system circuit board. Therefore, the antenna is limited to the position of the system circuit board in the hand-held electronic device. This causes the transmission performance of the antenna, e.g. the field type, the efficiency, the operating bandwidth or even the operating frequency band, to be deteriorated due to the interference from the nearby object. The ground metal also increases the size of the hand-held electronic device. In order to meet the requirement of various compact hand-held electronic devices, the size of the antenna also has to be further reduced. However, this may sacrifice the transmission performance of the antenna.

In order to overcome the drawbacks in the prior art, an antenna having a cable grounding area is provided. The particular design in the present invention not only solves the problems described above, but also is easy to be implemented. Thus, the present invention has the utility for the industry.

SUMMARY OF THE INVENTION

The present invention provides a built-in printed single frequency inverse-F antenna which is used on a printed circuit board and easily adjustable. The built-in printed single frequency inverse-F antenna of the present invention is suitable for the wireless transmission device. In addition, the present invention can be easily adjusted and corrected according to the requirement of the device to achieve the suitable application. The present invention can be applied to the requirement of the system frequency band with an operating frequency range of LTE Band 3 (1710~1880 MHz), DECT Band (1880~1890 MHz), LTE Band 1 (1920~2170 MHz), LTE Band 40 (2300~2400 MHz), WiFi-2G (2400~2500 MHz) or LTE Band 7 (2500~2690 MHz). For example, in the wireless communication device such as the notebook computer, the cellphone or the access point, the frequency range can be slightly adjusted to be applied to other operating frequency ranges of the wireless communication device.

The present invention provides a printed single frequency antenna which has a smaller size and can be suspended. The printed single frequency antenna is a circuit board with a planar structure. The manufacturing of the printed single frequency antenna does not need the mold so that the costs of the mold and the assembly are saved. In addition, the present invention can prevent the three-dimensional antenna structure from deformation. Furthermore, the printed single frequency antenna can be disposed in the electronic device alone in a suspending way. The antenna does not need to be manufactured on the edge of the system circuit board of the electronic device. The substrate of the antenna is connected to the radio signal module on the system circuit board via a 50 Ω cable. The 50 Ω cable is soldered to the substrate of antenna, and the length of the 50 Ω cable is properly adjusted. The position of antenna in the electronic device can be adjusted to any suitable position according to the requirement of application. This prevents the antenna from being interfered by the nearby object to affect the transmission performance of the antenna. Moreover, because the antenna does not need additional ground conductors, the size of the antenna can be reduced.

The present invention further provides an antenna whose operating frequency range can be adjusted according to the requirement of application, and a method of adjusting the operating frequency range and the impedance of the antenna. The present invention can easily adjust the antenna to achieve a suitable operating frequency. In addition, the present invention can adjust the impedance of the antenna to cause the antenna to achieve the best signal transmission efficiency.

In accordance with an aspect of the present invention, an antenna is provided. The antenna includes a feed-in terminal; a radiating portion extended from the feed-in terminal along a first direction to form a first hook portion; a connecting conductor extended from the feed-in terminal to a ground terminal along a second direction opposite to the first direction; and a ground portion extended from the ground terminal and having a cable grounding area, wherein the ground portion and the connecting conductor form a second hook portion opposite to the first hook portion; the cable grounding area has a longitudinal center line; and the first direction and the longitudinal center line form therebetween a specific angle ranging from 49-59 degrees.

In accordance with another aspect of the present invention, an antenna is provided. The antenna includes a radiating portion extended along a first direction; and a cable grounding area extended along a second direction, wherein the first direction and the second direction form therebetween a specific angle ranging from 49-59 degrees.

In accordance with a further aspect of the present invention, an antenna is provided. The antenna includes a feed-in terminal; a radiating portion extended from the feed-in terminal along a first direction; and a ground portion having a cable grounding area extended along a second direction, wherein the first direction and the second direction form therebetween a specific angle ranging from 49-59 degrees.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

Figure 1A:
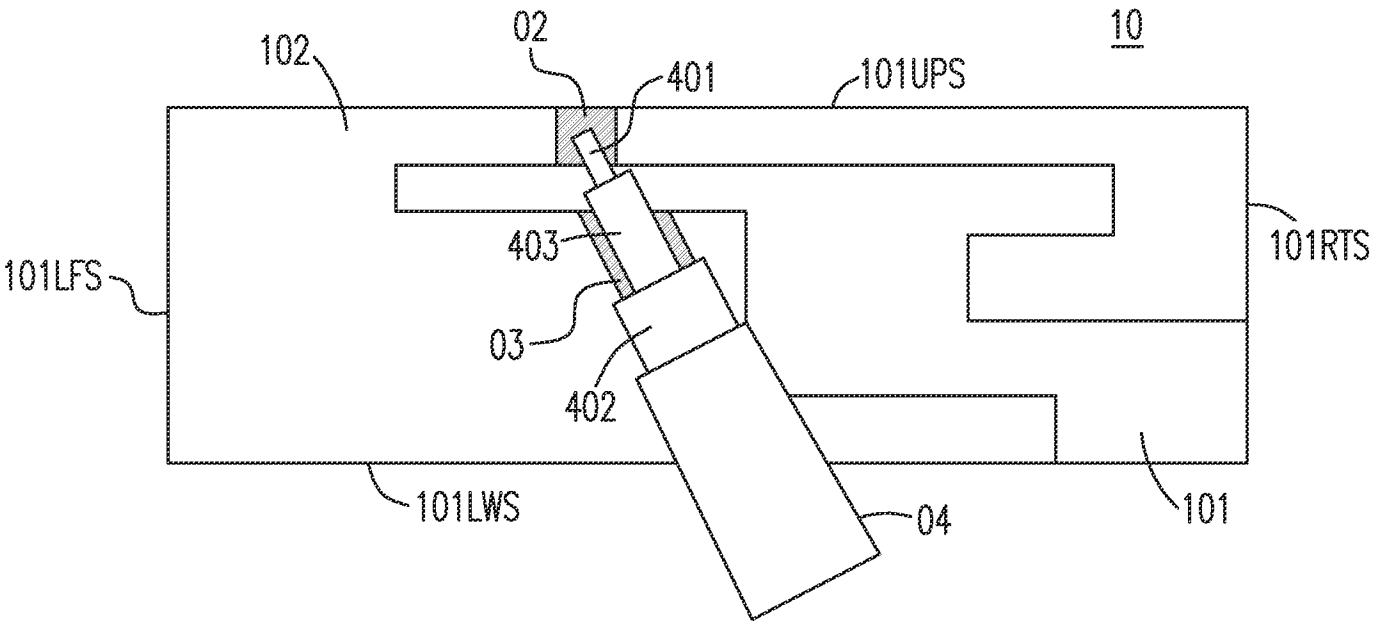
FIGS. 1(*a*)-1(*e*) are front views of an antenna according to an embodiment of the present invention.
Figure 1B:
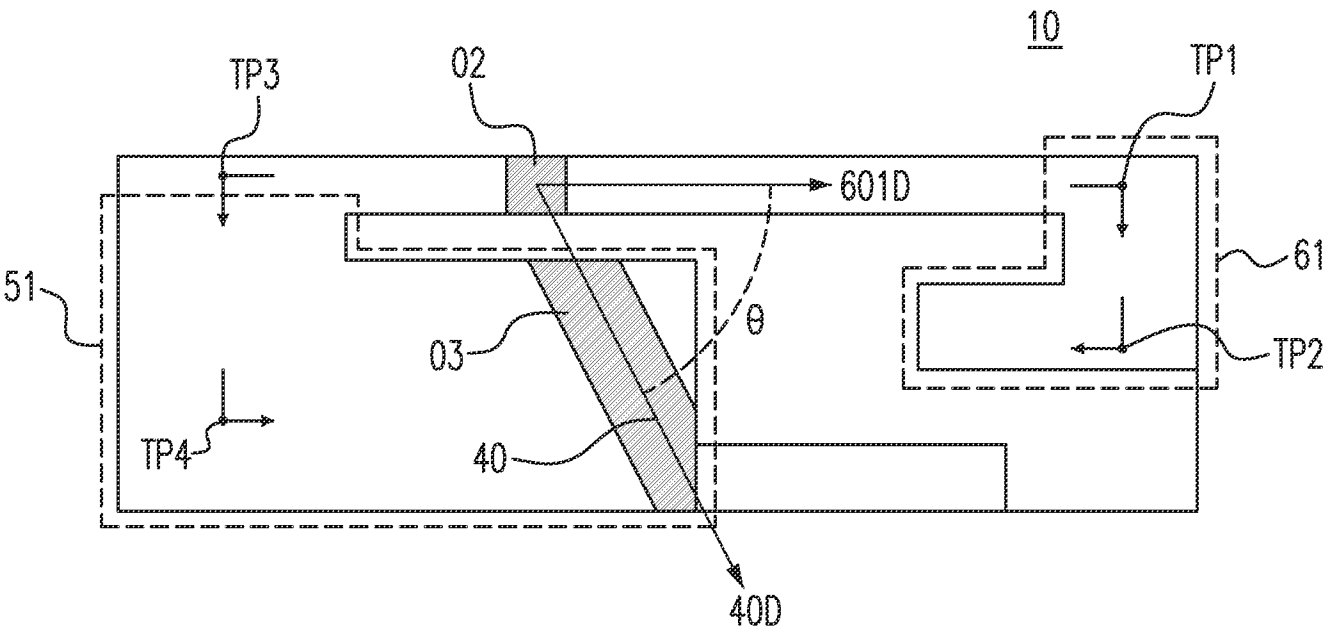
Figure 1C:
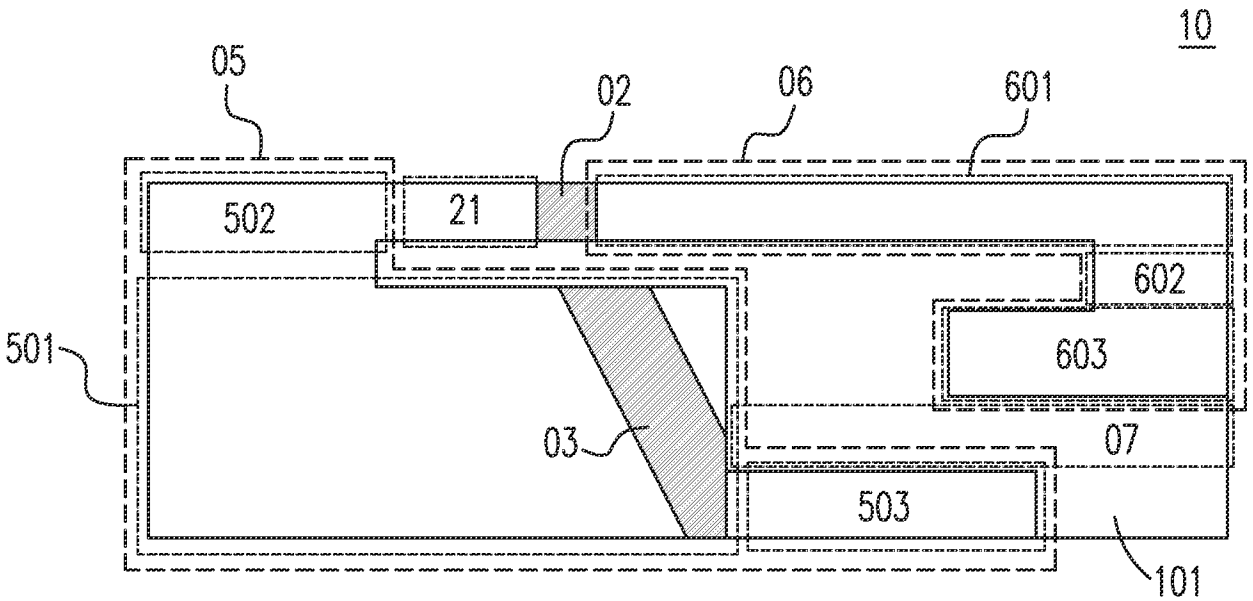
Figure 1D:
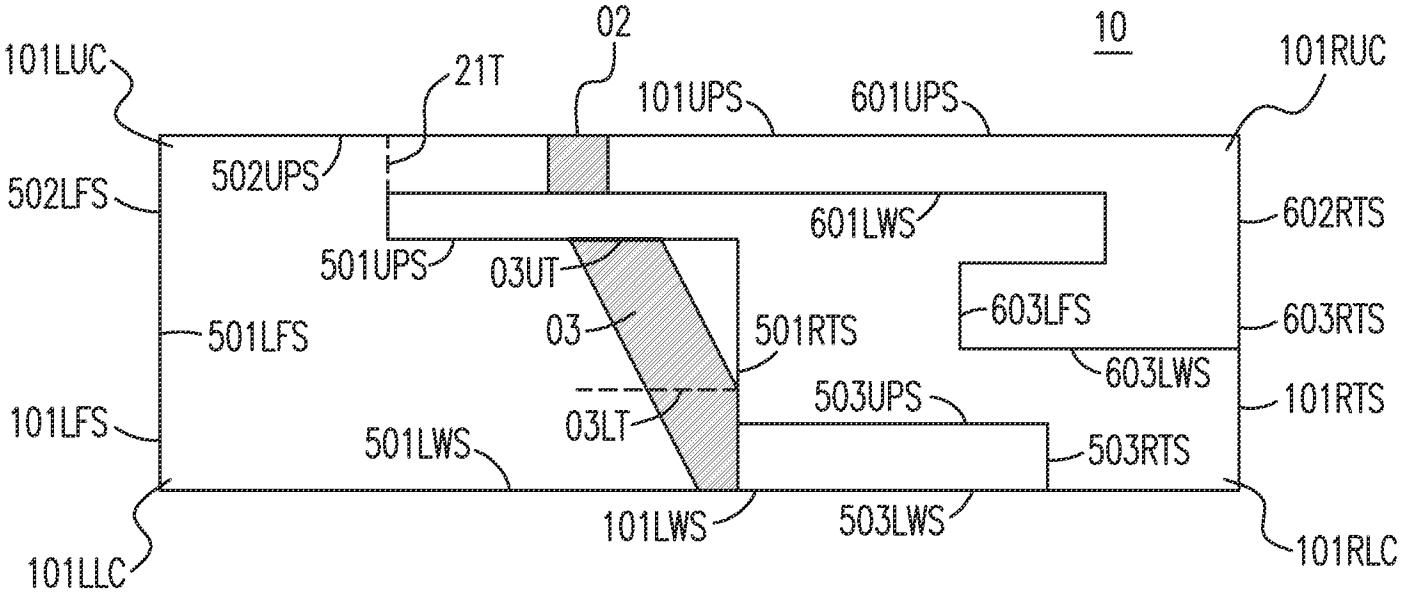
Figure 1E:
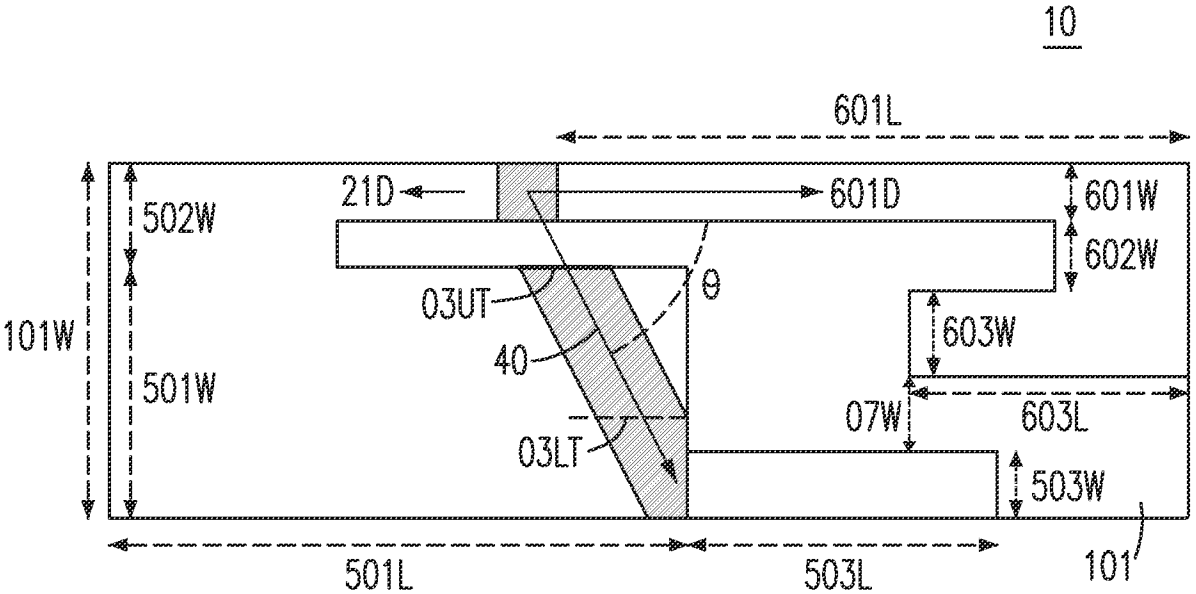

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Please refer to FIGS. 1(*a*)-1(*e*), which are front views of an antenna 10 according to an embodiment of the present invention. As shown in FIG. 1(*a*), the antenna 10 includes a substrate 101, an antenna conductor body 102 manufactured on the substrate 101, and a cable 04 having a resistor of 50Ω. The antenna conductor body 102 is connected to the cable 04, wherein a specific angle is formed between the antenna conductor 102 and the cable 04. The surface of the antenna conductor body 102 is coated with an insulating layer except for a feed-in terminal 02 and a cable grounding area 03. The insulating layer is used to insulate the antenna conductor body 102 and prevent it from oxidation.

The antenna 10 is a printed single frequency antenna which can be suspended. The antenna body conductor 11 is manufactured on the substrate 101. The substrate 101 can be disposed at any positions in the electronic device (not shown) in a suspending way. The antenna 10 does not need to be manufactured on the edge of the system circuit board (not shown) of the electronic device. The antenna 10 is connected to the radio signal module on the system circuit board via the cable 04. The cable 04 is soldered to the antenna conductor body 102, and the length of the cable 04 is properly adjusted. The antenna 10 can be disposed at any suitable positions in different electronic devices according to different requirements of applications. This prevents the antenna 10 from being interfered by the nearby object to affect the transmission performance of the antenna 10. Moreover, because it is unnecessary for the system circuit to provide additional ground conductors for the antenna 10, the size of the substrate 101 of the antenna 10 can be reduced.

The antenna 10 includes the feed-in terminal 02, a radiating portion 06, a connecting conductor 21 and a ground portion 05. The radiating portion 06 is extended from the feed-in terminal 02 along a first direction 601D to form a first hook portion 61. The connecting conductor 21 is extended from the feed-in terminal 02 to a ground terminal 21T along a second direction 21D opposite to the first direction 601D. The ground portion 05 is extended from the ground terminal 21T and has a cable grounding area 03. The ground portion 05 and the connecting conductor 21 form a second hook portion 51. The cable grounding area 03 has a longitudinal center line 40. The first direction 601D and the longitudinal center line 40 form therebetween a specific angle θ ranging from 49-59 degrees.

The first direction 601D is a first extending direction, and the second direction 21D is a second initial extending direction. Preferably, the specific angle θ ranges from 52-56 degrees. More preferably, the specific angle θ ranges from 53-55 degrees.

The substrate 101 includes a first surface and has a first width 101W. The first surface is rectangular, and has a first corner area 101LUC, a second corner area 101RUC, a third corner area 101RLC and a fourth corner area 101LLC. The antenna conductor body 102 includes the feed-in terminal 02, the connecting conductor 21, the ground portion 05 and the radiating portion 06. The ground portion 05 is disposed on the first surface, and includes a main ground portion 501, a first sub-ground portion 502 and a second sub-ground portion 503. The main ground portion 501 is disposed on the fourth corner area 101LLC, is rectangular, and includes a first edge 501UPS, a second edge 501RTS adjacent to the first edge 501UPS, a third edge 501LWS opposite to the first edge 501UPS, and a fourth edge 501LFS opposite to the second edge 501RTS.

The first sub-ground portion 502 is extended from the first edge 501UPS, and disposed on the first corner area 101LUC. In addition, the first sub-ground portion 502 is a rectangular conductor having a second width 502W. The second sub-ground portion 503 is extended from the second edge 501RTS toward the third corner area 101RLC. Moreover, the second sub-ground portion 503 is a rectangular conductor having a first inner edge 503UPS, a first outer edge 503LWS opposite to the first inner edge 503UPS, a second length 503L and a third width 503W. The radiating portion 06 is disposed on the first surface, and includes a first radiating conductor 601, a second radiating conductor 602 and a third radiating conductor 603.

The first radiating conductor 601 is extended from the feed-in terminal 02, and has a second inner edge 601LWS, a second outer edge 601UPS opposite to the second inner edge 601LWS, a first length 601L and a fourth width 601W. The second radiating conductor 602 is extended from the first radiating conductor 601, and has a third outer edge 602RTS and a fifth width 602W. The third radiating conductor 603 is extended from the second radiating conductor 602, and has a third inner edge 603LFS, a fourth outer edge 603RTS, a fifth outer edge 603LWS, a third length 603L and a six width 603W. The second width 502W is two-fifths of the first width 101W The third width 503W is one-fifth of the first width 101W. The fourth width 601W is one-fifth of the first width 101W. The fifth width 602W is one-fifth of the first width 101W The sixth width 603W is one-fifth of the first width 101W. The first length 601L is larger than the second length 503L and the third length 603L. The second length 503L is larger than the third length 603L. The radiating portion 06, the connecting conductor 21 and the ground portion 05 form thereamong a gap 07. The third radiating conductor 603 is extended to the cable grounding area 03 along a direction opposite to the first direction 601D.

The operating frequency band of the antenna 10 is determined by a total length being the sum of the first length 601L, the fourth width 601W and the third length 603L. The operating frequency band ranges from 2.4-2.5 GHz. The length from the feed-in terminal 02, through the connecting conductor 21 and the first sub-ground portion 502, to the cable grounding area 03 is equal to the total length. The total length is equal to one-fourth of the operating wavelength of the antenna 10.

The fourth edge 501LFS overlaps the left edge 101LFS of the substrate 101. The third edge 501LWS overlaps the lower edge 101LWS of the substrate 101. The left edge 502LFS of the first sub-ground portion 502 overlaps the left edge 101LFS of the substrate 101. The upper edge 502UPS of the first sub-ground portion 502 overlaps the upper edge 101UPS of the substrate 101. A first outer edge 503LWS of the second sub-ground portion 503 overlaps the lower edge 101LWS of the substrate 101. The first inner edge 503UPS is parallel to and adjacent to the fifth outer edge 603LWS of the third radiating conductor 603. The second outer edge 601UPS of the first radiating conductor 601 overlaps the upper edge 101UPS of the substrate 101. The third outer edge 602RTS of the second radiating conductor 602 overlaps the right edge 101RTS of the substrate 101.

The fifth outer edge 603LWS of the third radiating conductor 603 and the first inner edge 503UPS of the second sub ground portion 503 form therebetween a specific distance 07W. The specific distance 07W determines the impedance matching of the antenna 10.

The antenna 10 further includes a coaxial cable 04. The coaxial cable 04 includes a central conductor 401 and a shielded conductor 402 surrounding the central conductor 401. The cable grounding area 03 further has a first terminal 03UT and a second terminal 03LT opposite to the first terminal 03UT. The longitudinal center line 40 passes through the feed-in terminal 02, the first terminal 03UT and the second terminal 03LT. The central conductor 401 is electrically connected to the feed-in terminal 02, and the shielded conductor 402 is electrically connected to the cable grounding area 03.

As shown in FIGS. 1(*a*)-1(*e*), the antenna 10 includes the radiating portion 06 and the cable grounding area 03. The radiating portion 06 is extended along the first direction 601D. The cable grounding area 03 is extended along the third direction 40D. The first direction 601D and the third direction 40D form therebetween the specific angle θ ranging from 49-59 degrees.

The radiating portion 06 is extended to a first turning point TP1 to form the first radiating conductor 601. The first radiating conductor 601 is extended from the first turning point TP1 to a second turning point TP2 to form the second radiating conductor 602. The second radiating conductor 602 is extended from the second turning point TP2 to form a third radiating conductor 603.

As shown in FIGS. 1(*a*)-1(*e*), the antenna 10 includes the feed-in terminal 02, the radiating portion 06 and the ground portion 05. The radiating portion 06 is extended from the feed-in terminal 02 along the first direction 601D. The ground portion 05 has the cable grounding area 03 extended along the third direction 40D. The first direction 601D and the third direction 40D form therebetween the specific angle θ ranging from 49-59 degrees.

The length from the feed-in terminal 02, through the ground portion 05, to the cable grounding area. 03 equals one-fourth of the operating wavelength of the antenna 10. The surface of the antenna 10 is covered by an insulating layer except for the feed-in terminal 02 and the cable grounding area 03. The feed-in terminal 02 is electrically connected to a central conductor 401 of a cable 04. The cable grounding area 03 is electrically connected to a shielding conductor 402 of the cable 04.

The connecting conductor 21 is extended to a third turning point TP3 to form a first sub-ground portion 502. The first sub-ground portion 502 is extended from the third turning point TP3 to a fourth turning point TP4 to form a main ground portion 501. The main ground portion 501 is extended from the fourth turning point TP4 to the cable grounding area 03.

By adjusting at least one of the first length 601L, the fourth width 601W and the third length 603L, the operating frequency range of the antenna 10 can be LTE Band 3 (1710~1880 MHz), DECT Band (1880~1890 MHz), LIE Band 1 (1920~2170 MHz), LTE Band 40 (2300~2400 MHz) or LTE Band 7 (2500~2690 MHz).

The main ground portion 501 of the ground portion 05 is extended toward the third radiating conductor 603 along the lower edge 101LWS of the substrate 101 to form the second sub-ground portion 503, wherein the second sub-ground portion 503 is adjacent to and parallel to the third radiating conductor 603. The second length 503L of the second sub-ground portion 503 is approximately larger than a half of the length 501L of the main ground portion 501.

There is a capacitive coupling between the second sub-ground portion 503 and the third radiating conductor 603. The magnitude of the capacitive coupling is determined by the size of the gap 07 surrounded by the main ground portion 501, the second sub-ground portion 503 and the third radiating conductor 603. The impedance matching of the antenna 10 is determined by the capacitive coupling.

The impedance matching of the antenna 10 is adjusted by changing at least one of the third length 603L of the third radiating conductor 603, the second length 503L of the second sub-ground portion 503, and the vertical distance 07W between the third radiating conductor 603 and the first sub-ground portion 502.

The second width 502W of the first sub-ground portion 502 is set to be approximately larger than a half of the width 501W of the main ground portion 501. In addition, the cable grounding area 03 is disposed at the right side of the main ground portion 501 of the antenna 10. There is the specific angle θ between the longitudinal center line 40 of the cable ground area 03 and the upper edge 101UPS of the substrate 101 of the antenna 10. The length of the average current path of the antenna 10 is extended from the feed-in terminal 02 along the second direction 21D, through the connecting conductor 21, the third turning point TP3 on the first sub-ground portion 502 and the fourth turning point TP4 on the main ground portion 501, to the cable grounding area 03. The specific angle θ is set to cause the length of the average current path of the antenna 10 to approximately equal one-fourth of the operating wavelength of the antenna 10. Through the above-mentioned design, the current from the feed-in terminal 02 to the cable grounding area 03 of the antenna 10 is uniformly distributed on the connecting conductor 21, the first sub-ground portion 502 and the main ground portion 501. Therefore, the area of the antenna 10 only needs to be 30% of that of the conventional antenna, and the length of the antenna 10 only needs to be 60% of that of the conventional antenna to achieve the requirement of the transmission characteristics of the antenna 10. According to an embodiment of the present invention, the specific angle is set to range from 53-55 degrees. In this way, the size of the antenna 10 can be far smaller than that of the conventional antenna, which is about 28 mm×8.2 mm.

Figure 2:
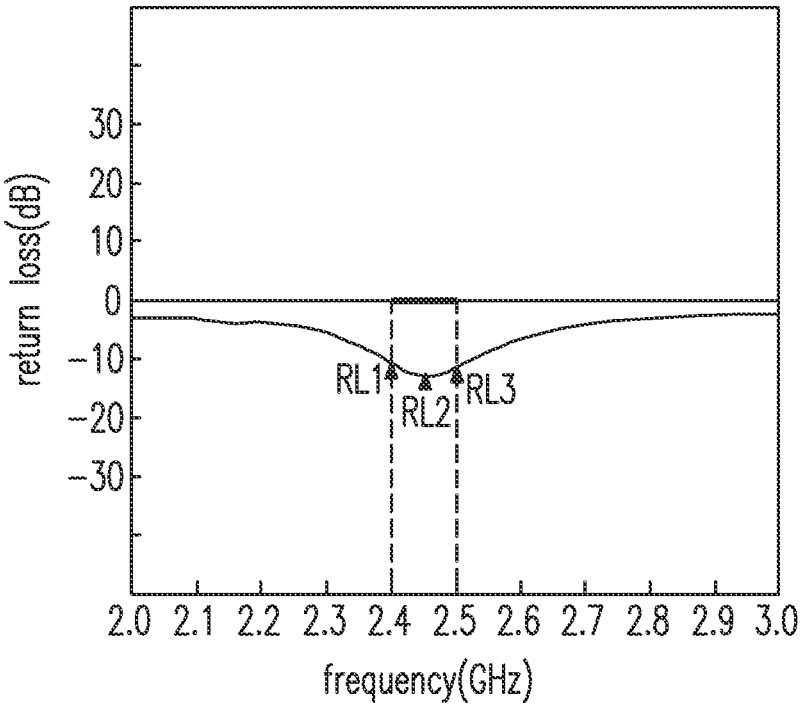
FIG. 2 shows the relationship between the return loss and the frequency band of the antenna in FIGS. 1(*a*)-1(*e*).

Please refer to FIG. 2, which shows the relationship between the return loss and the frequency band of the antenna 10 in FIGS. 1(*a*)-1(*e*). The return loss RL1 for the frequency of 2.4 GHz is −10.729 dB, the return loss RL2 for the frequency of 2.45 GHz is −12.789 dB, and the return loss RL3 for the frequency of 2.5 GHz is −11.295 dB. The return losses RL1, RL2 and RL3 are all below the desired maximum value "−10 dB", and a bandwidth of 100 MHz is obtained. The above-mentioned bandwidth is included in the bandwidth under the wireless communication WiFi 2G frequency band standard.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna, comprising:

a substrate having a first surface and a first width;

a feed-in terminal;

a radiating portion extended from the feed-in terminal along a first direction to form a first hook portion;

a connecting conductor extended from the feed-in terminal to a ground terminal along a second direction opposite to the first direction; and a ground portion extended from the ground terminal and having a cable grounding area; wherein:

the ground portion and the connecting conductor form a second hook portion opposite to the first hook portion;

the cable grounding area has a longitudinal center line and is located under a coaxial cable;

the first direction and the longitudinal center line form therebetween a specific angle ranging from 49-59 degrees;

the first surface is rectangular and has a first corner area, a second corner area, a third corner area and a fourth corner area;

the second hook portion is located on the first and the fourth corner areas; and the ground portion is disposed on the first surface, and includes:

a main ground portion disposed on the fourth corner area, being rectangular, and including a first edge, a second edge adjacent to the first edge, a third edge opposite to the first edge, and a fourth edge opposite to the second edge;

a first sub-ground portion extended from the first edge, disposed on the first corner area, and being a rectangular conductor having a second width; and a second sub-ground portion extended from the second edge toward the third corner area, and being a rectangular conductor having a first inner edge, a first outer edge opposite to the first inner edge, a second length and a third width.

2. The antenna as claimed in claim 1, wherein:

the radiating portion is disposed on the first surface, and includes:

a first radiating conductor extended from the feed-in terminal, and having a second inner edge, a second outer edge opposite to the second inner edge, a first length and a fourth width;

a second radiating conductor extended from the first radiating conductor, and having a third outer edge and a fifth width; and a third radiating conductor extended from the second radiating conductor, and having a third inner edge, a fourth outer edge, a fifth outer edge, a third length and a six width; and the first inner edge is parallel to and adjacent to the fifth outer edge.

3. The antenna as claimed in claim 2, wherein:

the second width is two-fifths of the first width;

the third width is one-fifth of the first width;

the fourth width is one-fifth of the first width;

the fifth width is one-fifth of the first width;

the sixth width is one-fifth of the first width;

the first length is larger than the second length; and the second length is larger than the third length.

4. The antenna as claimed in claim 2, wherein:

the radiating portion, the connecting conductor and the ground portion form thereamong a gap; and the third radiating conductor is extended to the cable grounding area along a direction opposite to the first direction.

5. The antenna as claimed in claim 2, wherein:

the antenna has an operating frequency band determined by a total length being the sum of the first length, the fourth width and the third length;

a length from the feed-in terminal, through the connecting conductor and the first sub-ground portion, to the cable grounding area is equal to the total length; and the total length is equal to one-fourth of an operating wavelength of the antenna.

6. The antenna as claimed in claim 2, wherein:

the substrate has a left edge and a lower edge;

the fourth edge overlaps the left edge; and the third edge overlaps the lower edge.

7. The antenna as claimed in claim 6, wherein:

the first sub-ground portion has a left edge overlapping the left edge of the substrate having an upper edge; and the first sub-ground portion has an upper edge overlapping the upper edge of the substrate.

8. The antenna as claimed in claim 7, wherein the second sub-ground portion has a first outer edge overlapping the lower edge of the substrate.

9. The antenna as claimed in claim 8, wherein the second outer edge overlaps the upper edge of the substrate.

10. The antenna as claimed in claim 6, wherein the substrate further comprises a right edge, and the third outer edge overlaps the right edge of the substrate.

11. The antenna as claimed in claim 1, wherein:

the fifth outer edge and the first inner edge of the second sub ground portion form therebetween a specific distance; and the specific distance determines an impedance matching of the antenna.

12. The antenna as claimed in claim 1, wherein the coaxial cable has a central conductor coupled to the feed-in terminal and a shielded conductor surrounding the central conductor.

13. The antenna as claimed in claim 12, wherein:

the cable grounding area further has a first terminal, and a second terminal opposite to the first terminal; and the longitudinal center line passes through the feed-in terminal, the first terminal and the second terminal.

14. The antenna as claimed in claim 13, wherein the shielded conductor is electrically connected to the cable grounding area.

15. An antenna, comprising:

a substrate having a first surface and a first width;

a radiating portion extended along a first direction; and a cable grounding area extended along a second direction, and located under a coaxial cable, wherein:

the first direction and the second direction form therebetween a specific angle ranging from 49-59 degrees;

the first surface is rectangular and has a first corner area, a second corner area, a third corner area and a fourth corner area; and the antenna further includes a ground portion disposed on the first surface, and including:

a main ground portion disposed on the fourth corner area, being rectangular, and including a first edge, a second edge adjacent to the first edge, a third edge opposite to the first edge, and a fourth edge opposite to the second edge, a first sub-ground portion extended from the first edge, disposed on the first corner area, and being a rectangular conductor having a second width; and a second sub-ground portion extended from the second edge toward the third corner area and being a rectangular conductor having a first inner edge a first outer edge opposite to the first inner edge, a second length and a third width.

16. The antenna as claimed in claim 15, wherein:

the radiating portion is extended to a first turning point to form a first radiating conductor;

the first radiating conductor is extended from the first turning point to a second turning point to form a second radiating conductor; and the second radiating conductor is extended from the second turning point to form a third radiating conductor.

17. An antenna, comprising:

a substrate having a first surface and a first width;

a feed-in terminal;

a radiating portion extended from the feed-in terminal along a first direction; and a ground portion having a cable grounding area extended along a second direction and located under a coaxial cable, wherein:

the first direction and the second direction form therebetween a specific angle ranging from 49-59 degrees;

the first surface is rectangular and has a first corner area, a second corner area a third corner area and a fourth corner area; and the ground portion is disposed on the first surface, and includes:

a main ground portion disposed on the fourth corner area, being rectangular, and including a first edge, a second edge adjacent to the first edge, a third edge opposite to the first edge, and a fourth edge opposite to the second edge;

a first sub-ground portion extended from the first edge, disposed on the first corner area, and being a rectangular conductor having a second width; and a second sub-ground portion extended from the second edge toward the third corner area, and being a rectangular conductor having a first inner edge, a first outer edge opposite to the first inner edge, a second length and a third width.

18. The antenna as claimed in claim 17, further comprising a surface and an insulating layer, wherein:

a length from the feed-in terminal, through the ground portion, to the cable grounding area equals one-fourth of the operating wavelength of the antenna; and the surface of the antenna is covered by the insulating layer except for the feed-in terminal and the cable grounding area;

the feed-in terminal is electrically connected to a central conductor of the coaxial cable; and the cable grounding area under the coaxial cable is electrically connected to a shielding conductor of the coaxial cable.

* * * * *